US008875637B2

(12) United States Patent
Sherman et al.

(10) Patent No.: US 8,875,637 B2
(45) Date of Patent: Nov. 4, 2014

(54) TABLE ACCESS DOOR

(71) Applicant: Inscape Corporation, Holland Landing (CA)

(72) Inventors: John D. Sherman, Markham (CA); David Parshad, Markham (CA); Ivan Liu, Markham (CA)

(73) Assignee: Inscape Corporation, Holland Landing, Ontario (CA)

( * ) Notice: Subject to any disclaimer, the term of this patent is extended or adjusted under 35 U.S.C. 154(b) by 0 days.

(21) Appl. No.: 13/834,375

(22) Filed: Mar. 15, 2013

(65) Prior Publication Data

US 2014/0261104 A1 Sep. 18, 2014

(51) Int. Cl.
*A47B 37/00* (2006.01)
*A47B 13/08* (2006.01)

(52) U.S. Cl.
CPC ..... *A47B 13/088* (2013.01)
USPC ..... 108/50.02

(58) Field of Classification Search
USPC ..... 108/3, 25, 26, 50.01, 50.02; 312/27–30, 312/223.3, 246, 327–328
See application file for complete search history.

(56) References Cited

U.S. PATENT DOCUMENTS

| | | | | |
|---|---|---|---|---|
| 2,240,551 | A * | 5/1941 | Cooper | 108/86 |
| 2,590,028 | A | 3/1952 | Miller | |
| 4,145,097 | A * | 3/1979 | Naess et al. | 312/223.3 |
| 4,316,082 | A * | 2/1982 | Fritz | 235/146 |
| 4,596,416 | A | 6/1986 | Muller | |
| 4,792,881 | A | 12/1988 | Wilson | |
| 6,162,071 | A | 12/2000 | Muller | |
| 6,338,301 | B1 | 1/2002 | Almond | |
| 6,732,661 | B2 | 5/2004 | Grasse et al. | |
| 6,846,052 | B2 * | 1/2005 | Kelley et al. | 312/208.1 |
| 6,895,868 | B1 | 5/2005 | Cronk | |
| 2009/0165679 | A1 | 7/2009 | Bakker et al. | |

* cited by examiner

*Primary Examiner* — Matthew Ing
(74) *Attorney, Agent, or Firm* — Riches McKenzie & Herbert LLP

(57) ABSTRACT

An access door which opens and closes an opening that extends through a surface by which access is provided through the surface as, for example, to communication and power outlets, wires, cables, cable raceways, switches and the like behind the surface.

4 Claims, 6 Drawing Sheets

31
91
64
64a
63
62a
61a
59
61
62
63
70
60
65
66
67
68
69
71

22
34
37
39
5

TABLE ACCESS DOOR

SCOPE OF THE INVENTION

This invention relates to an access door for providing access through a surface preferably a worksurface of a desk or table.

BACKGROUND OF THE INVENTION

Systems are known in which an access door is provided through the worksurface of tabletop for providing for access to outlets for utilities disposed below the work and for passage of wires for such utilities, notably communication and power wires from below the worksurface to above the work surface. For example, U.S. Pat. No. 4,792,881 to Wilson, issued Dec. 20, 1988, shows a horizontal hinged access door for access to communication and power cables as does each of U.S. Pat. No. 6,162,071 to Muller, issued Dec. 19, 2000 and U.S. Pat. No. 6,895,868 to Cronk, issued May 24, 2005.

SUMMARY OF THE INVENTION

The present invention in one aspect provides an access door which opens and closes an opening that extends through a surface by which access is provided through the surface as, for example, to communication and power outlets, wires, cables, cable raceways, switches and the like behind the surface.

In another aspect, the present invention provides a worksurface having an upper surface and a lower surface, and an opening through the work surface, a movable access door having an upper door surface, in a closed position, the door surface is flush with the upper surface of the worksurface across the opening, in an open position, the door is disposed under the worksurface adjacent to the opening with the upper door surface directed into opposition with the lower surface of the worksurface adjacent to the opening, the opening having an opening front end, an opening rear end, an opening right side and an opening left side, the opening right side and the opening left side joining the opening front end and the opening rear end, a right bracket member secured to the lower surface adjacent the opening right side, a left bracket member parallel to the right bracket member secured to the lower surface adjacent the opening left side, each of the right bracket member and the left bracket member extending downwardly away from the lower surface normal to the lower surface, slotways comprising a generally Y-shaped right slotway in the right bracket member, and a generally Y-shaped left slotway in the left bracket member identical to the right slotway, the door having a door front end, a door rear end, a door right side and a door left side, the door right side and the door left side joining the door front end and the door rear end, the door having a carriage which extends downwardly from the door surface, the carriage having a carriage right side and a carriage left side, rollers carried on the carriage comprising a right front roller, a left front roller, a right rear roller and a left rear roller, the right front roller mounted on the carriage right side proximate the door front end for rotation about a front axis, the right rear roller mounted on the carriage right side proximate the door rear end for rotation about a rear axis parallel the front axis spaced rearwardly from the front axis, the left front roller mounted on the carriage left side proximate the door front end for rotation about the front axis, the left rear roller mounted on the carriage left side proximate the door rear end for rotation about the rear axis, the right front roller and right rear roller rollably engaged within the right slotway of the right bracket member for movement longitudinally therein, the left front roller and the left rear roller engaged within the left slotway of the left bracket member for movement longitudinally therein, each slotway having a front portion, a rear portion, a lower branch portion and an upper branch portion, each front portion having a front end and a rear end, each rear portion having a front end and a closed rear end, the rear end of the front portion opening into the front end of the rear portion, the front portion extending from its front end to its rear end parallel to the lower surface, the rear portion extending from its front end upwardly toward the lower surface as it extends away from its front end, each lower branch portion having a lower end and an upper end, each upper branch portion having a closed front end and a rear end, the lower branch portion extending upwardly from rear portion spaced from the rear end of the rear portion with the lower end of the lower branch portion within the rear portion, the upper end of the lower branch portion opening into the rear end of the upper branch portion, the lower branch portion extending from its lower end to its upper end upwardly toward the lower surface, the upper branch portion extending from its rear end toward its forward end forwardly and parallel the lower surface, wherein:

(i) in the closed position of the door:

(a) each front roller is in the respective upper branch of each slotway engaged with the forward end of the upper branch, and (b) each rear roller is in the respective rear portion of each slotway, (ii) in an upper intermediate position of the door:

(a) each front roller is at the junction of the respective upper branch of each slotway and the lower branch of the of each slotway, (b) each rear roller is in the respective rear portion of the slotway, (iii) in a lower intermediate position of the door:

(a) each front roller is at the junction of the respective lower branch and the rear portion of each slotway, and (b) each rear roller is in the respective rear portion of each slotway engaged with the rear end of the rear portion, (iv) in the closed position of the door:

(a) each front roller is in the respective front portion of each slotway, (b) each rear roller is in the front portion of each slotway rearward of each front roller, wherein:

with rolling engagement of the rollers in the slotways when the door is in a position between the rear intermediate position and the closed position or in the closed position, due to gravity the door is biased towards the closed position and moves to the closed position when displaced therefrom, with rolling engagement of the rollers in the slotways when the door is in the rear intermediate position or between the rear intermediate position and the forward intermediate position, due to gravity the door is biased towards the forward intermediate position and moves to the forward intermediate position when displaced, with rolling engagement of the rollers in the slotways when the door is in the forward intermediate position or positions between the forward intermediate position and the open position in which the rear rollers are in the rear portion, due to gravity the door is biased towards the open position and moves toward the open position when displaced away from the open position.

In a further aspect, the present invention provides a worksurface having an upper surface and a lower surface, and an opening through the work surface, a movable access door having an upper door surface, in a closed position, the door surface is flush with the upper surface of the worksurface across the opening, in an open position, the door is disposed under the worksurface adjacent to the opening with the upper door surface facing the lower surface of the workpiece adjacent to the opening and the upper door surface directed into opposition with the lower surface of the worksurface adjacent to the opening, the opening having an opening front end, an opening rear end, an opening right side and an opening left side, the opening right side and the opening left side joining the opening front end and the opening rear end, a right bracket member secured to the lower surface adjacent the opening right side, a left bracket member parallel to the right bracket member secured to the lower surface adjacent the opening left side, each right and left bracket member extending downwardly away from the under surface normal to the lower surface, the right bracket having a right first slotway and a right second slotway, the left bracket having a left first slotway and a left second slotway identical respectively to the right first slotway and the left second slotway of the first bracket, the door having a door front end, a door rear end, a door right side and a door left side, the door right side and the door left side joining the door front end and the door rear end, the door having a carriage which extends downwardly from the door, the carriage having a carriage right side and a carriage left side, the carriage having a right front roller, a left front roller, a right rear roller and a left rear roller, the right front roller mounted on the carriage right side proximate the door front end for rotation about a front axis, the right rear roller mounted on the carriage right side proximate the door rear end for rotation about a rear axis parallel the front axis spaced rearwardly from the front axis a distance, the left front roller mounted on the carriage left side proximate the door front end for rotation about the front axis, the left rear roller mounted on the carriage left side proximate the door rear end for rotation about the rear axis, the right front roller engaged within the first slotway of the right bracket member, the right rear roller engaged within the second slotway of the right bracket member, the left front roller engaged within the first slotway of the left bracket member, the left rear roller engaged within the second slotway of the left bracket member, each first slotway having a front first slotway portion and a rear first slotway portion, each front first slotway portion having a closed front end and a rear end, each rear first slotway portion having a front end and a rear end, the rear end of the front first slotway portion opening into the front end of the rear first slotway portion, the front first slotway portion extending generally parallel to the lower surface, the rear first slotway portion extending from its front end upwardly toward the lower surface as it extends away from its front end, each second slotway having a front second slotway portion, a lower branch portion and an upper branch portion, each front second slotway portion having a closed front end and a rear end, each lower branch portion having a lower end and an upper end, each upper branch portion having a closed front end and a rear end, the rear end of the front second slotway portion opening into the lower end of the lower branch portion, the upper end of the lower branch portion opening into the rear end of the upper branch portion, each front second slotway portion extending parallel to the outer surface outer surface, the lower branch portion extending from its lower end to its upper end upwardly toward the lower surface, the upper branch portion extending from its rear end toward its forward end forwardly and downwardly away from the lower surface, in the closed position of the door:

(a) each front roller is in the respective upper branch of the first slotway engaged with the forward end of the upper branch, (b) each rear roller is in the respective rear first slotway portion of the second slotway, in a rear intermediate position of the door:

(a) each front roller is at the junction of the respective upper branch of the first slotway and the lower branch of the of the first slotway, and (b) each rear roller is in the respective rear first slotway portion of the second slotway, in a front intermediate position of the door:

(a) each front roller is at the junction of the respective lower branch of the first slotway and the front first slotway portion of the first slotway, and (b) each rear roller is in the respective rear first slotway portion of the second slotway engaged with the rear end of the rear first slotway portion of the second slotway, in the closed position of the door:

(a) each front roller is in the respective front first slotway portion of the first slotway, (b) each rear roller is in the respective front second slotway portion of the second slotway, and (c) either each front roller is in engagement with the front end of the front first slotway portion of the first slotway or the each rear roller is in engagement with the front end of the front second slotway portion of the second slotway, when the door is in a position between the rear intermediate position and the closed position or in the closed position, due to gravity the door is biased towards the closed position and moves to the closed position with rolling engagement of the first and second rollers in the respective slotways, when the door is in the rear intermediate position or between the rear intermediate position and the forward intermediate position, due to gravity the door is biased towards the forward intermediate position and moves to the forward intermediate position with rolling engagement of the first and second rollers in the respective slotways, when the door is in the forward intermediate position or between the forward intermediate position and the open position, due to gravity the door is biased towards the open and moves to the open position with rolling engagement of the first and second rollers in the respective slotways.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
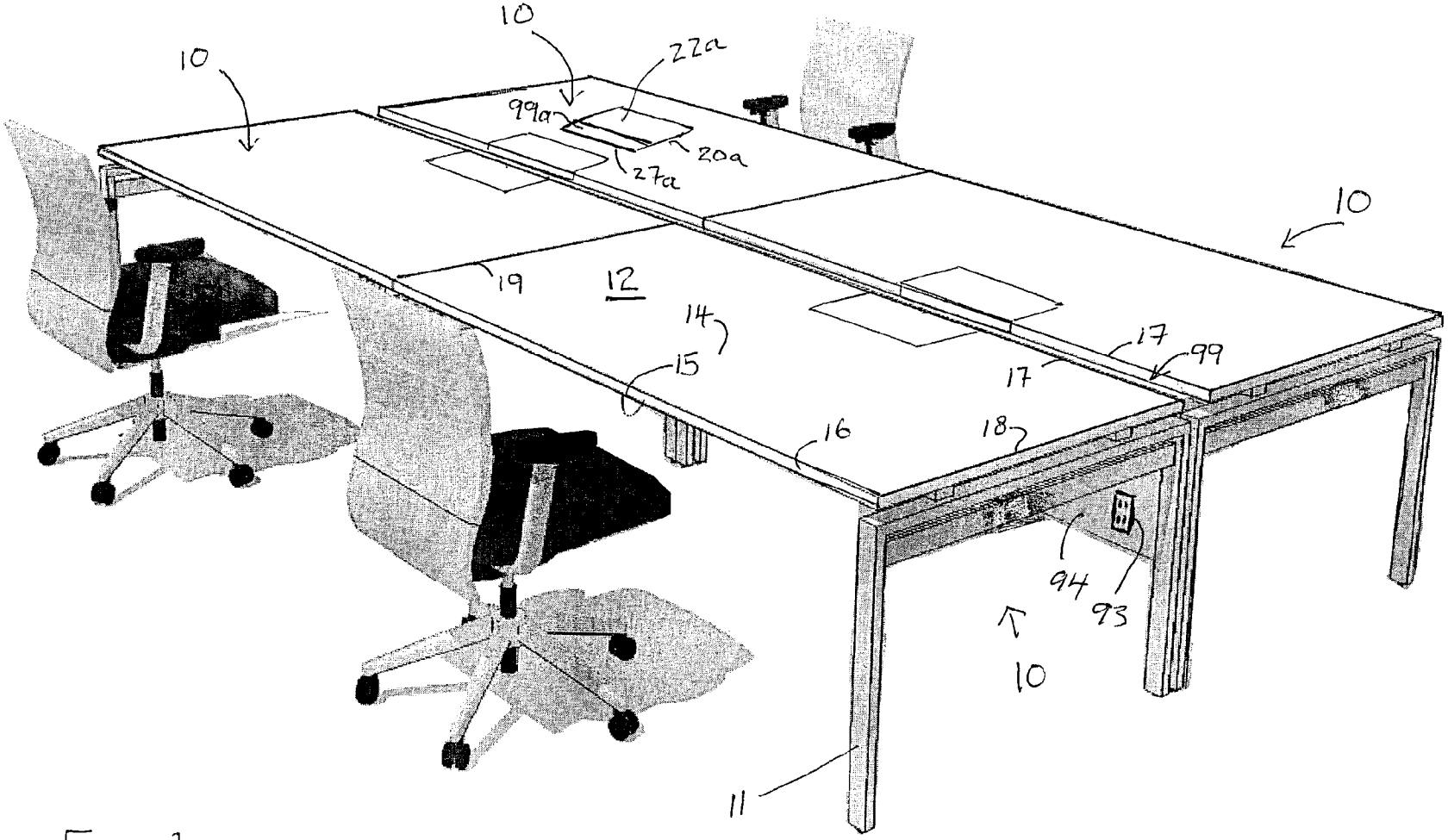
FIG. 1 is a pictorial view of tables having access doors in accordance with the first embodiment of the present invention.
Figure 10B:
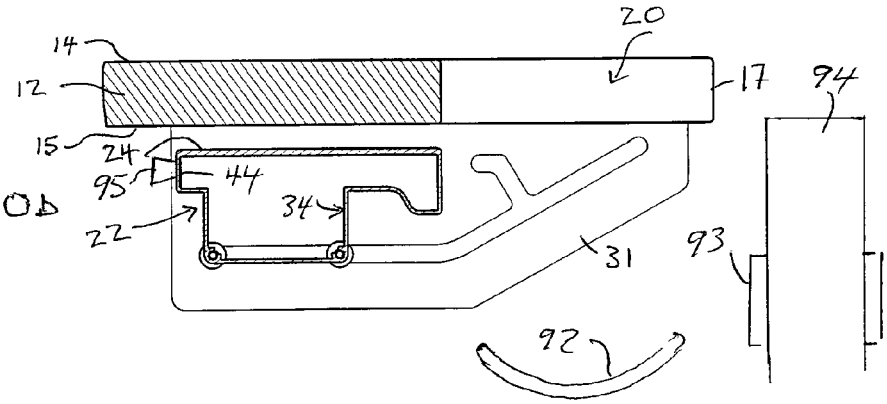

Reference is made first to FIG. 1 which shows a grouping of four tables 10, each of which has leg structures 11 at each end to support a worksurface 12. Each worksurface 12 has an upper surface 14, a lower surface 15, a front 16, a rear 17, a right end 18 and a left end 19. In FIG. 1, the four tables 10 are shown with two pairs of the tables arranged end-to-end and each table also arranged such that the rear end 17 opposes the rear 17 of an opposite table, preferably spaced therefrom by a space 99. As can best be seen in FIG. 10*a*, an opening 20 is provided through the worksurface 12 and a movable access door 22 is provided which can be moved between the open position of FIG. 10*a* to the closed position of FIG. 6*a* to open and close the opening 20. The door 22 has an upper door surface 24. As seen in the closed positions of FIGS. 6*a* and 6*b*, in the closed position, the door surface 24 is flush with the upper surface 14 of the worksurface 12 across the opening 20. In the open position as seen in FIG. 10*a* and FIG. 10*b*, the door 22 is disposed under the worksurface 12 adjacent to the opening 20 with the upper door surface 24 facing the lower surface 15 of the worksurface 12 and the upper door surface 22 directed upwardly in opposition to the downwardly directed lower surface 15 of the worksurface 12.

Figures 6A, 7A, 8A, 9A, 10A:
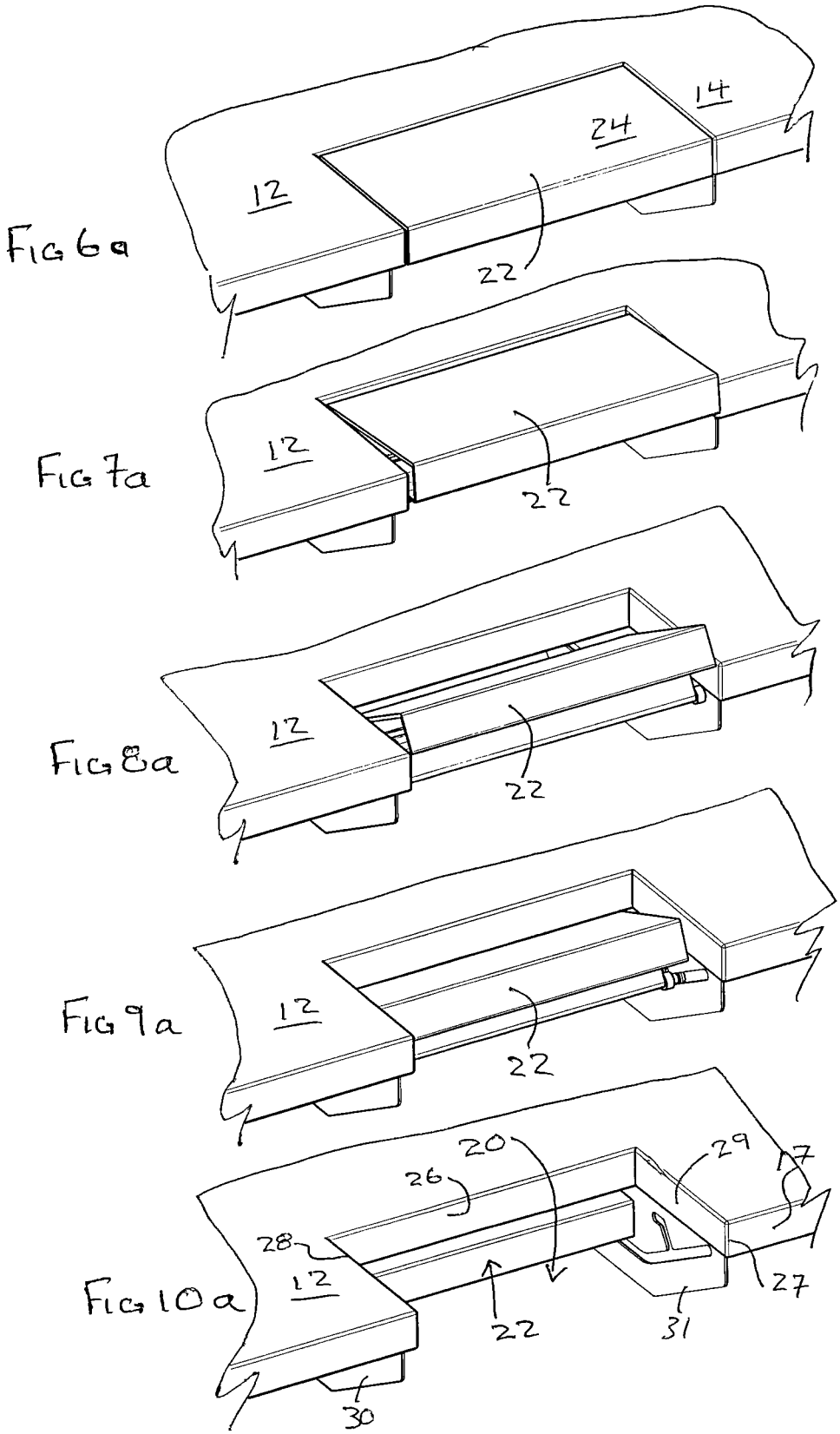
FIGS. 6*a*, 7*a*, 8*a*, 9*a* and 10*a* are each a rear upper perspective view showing the access door and the worksurface in different positions, namely, a closed position in FIG. 6*a*, an upper intermediate position in FIG. 7*a*, a lower intermediate position in FIG. 8*a*, a travel position in FIG. 9*a* and an open position in FIG. 10*a;*

Referring to FIG. 10*a*, the opening 20 has an opening front end 26, an opening rear end 27, an opening right side 28 and an opening left side 29. The opening right side 28 and the opening left side 29 extend between and join the opening front end 26 and the opening rear end 27. In the preferred embodiment shown, the opening 20 is disposed proximate the rear 17 of the worksurface 12 such that the opening 20 opens through the rear 17 of the worksurface 12 and thus has the opening rear end 27 opened outwardly through the rear 17.

Figure 3:
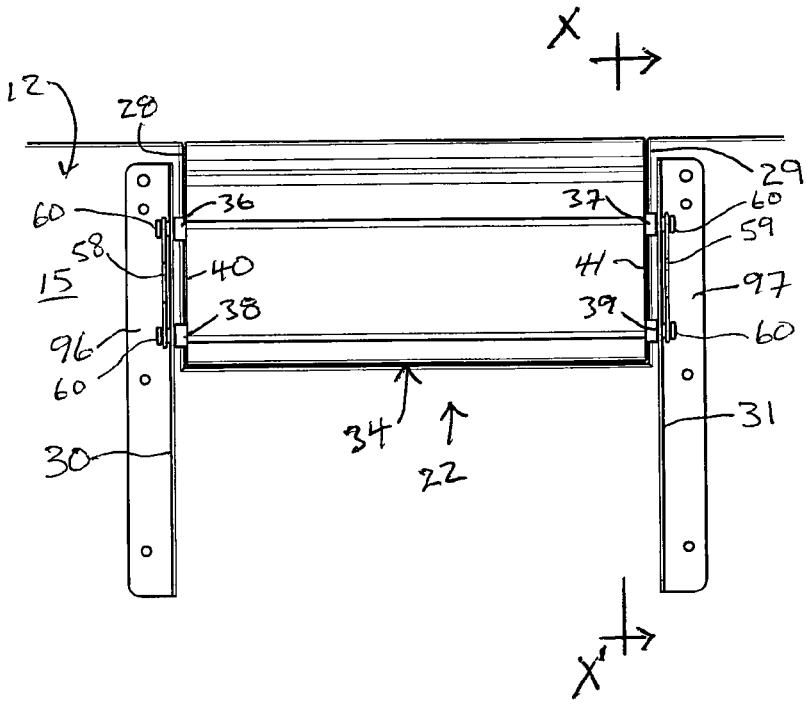
FIG. 3 is a bottom view of the worksurface and access door of FIG. 2.
Figure 2:
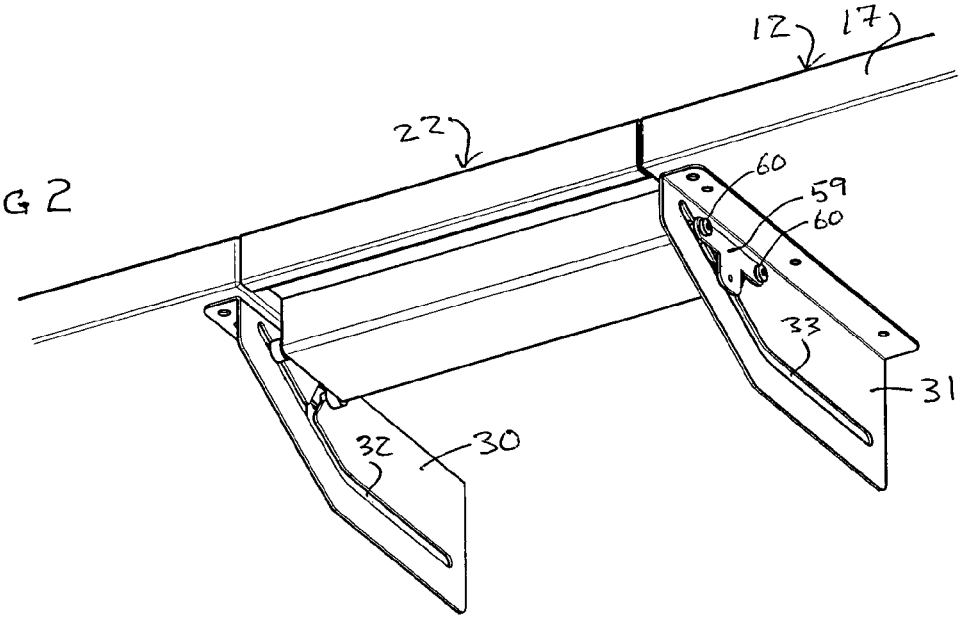
FIG. 2 is a pictorial bottom view of a worksurface of one of the tables of FIG. 1 showing one of the access doors.

Referring to FIGS. 2 and 3, a right bracket member 30 is secured to the lower surface 15 of the worksurface 12 adjacent the opening right side 28. A left bracket member 31 is secured to the lower surface 15 of the worksurface 12 adjacent the opening left side 29. Each of the right bracket member 30 and the left bracket member 31 extend downwardly from the under surface 15 normal to the lower surface 15 of the worksurface 12. In the preferred embodiment, the worksurface 12 is disposed to be horizontal with each of the upper surface 14 and the lower surface 15 disposed to be horizontal although, as will be discussed later, this is not necessary. The right bracket member 30 and the left bracket member 31 are parallel to each other and disposed in planes which extend vertically downwardly normal to the lower surface 15. As shown, each of the right bracket member 30 and left bracket member 31 may be secured to the lower surface 15 as by a horizontally extending support flanges 96 and 97. Slotways are provided in the right bracket member 30 and the left bracket member 31 to guide the travel of the door 22. A generally Y-shaped right slotway 32 is provided in the right bracket 30 and a generally Y-shaped left slotway 33 is provided in the left bracket member 31. The left slotway 33 in the preferred embodiment is identical to the right slotway 32.

Figure 5:
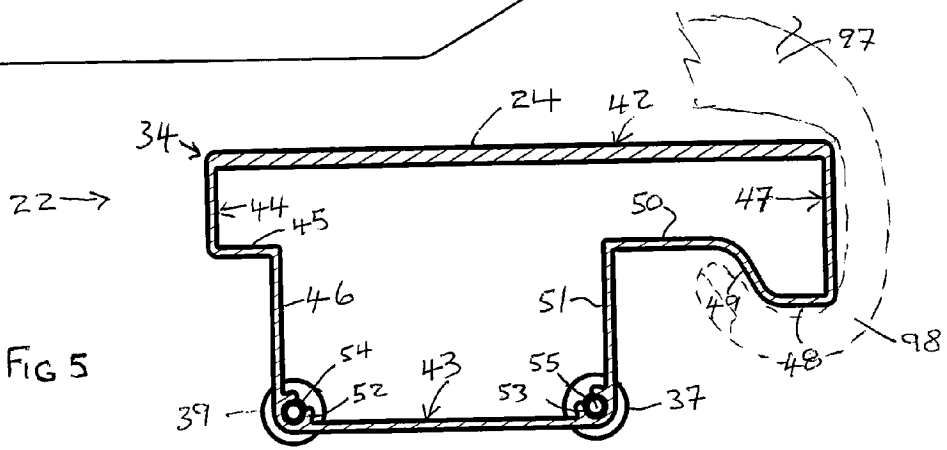
FIG. 5 is a vertical cross-sectional left side view of the door assembly along section line X-X' in FIG. 3.

Reference is made to FIGS. 2, 3 and 5 showing the door 22.

As can be best seen in FIG. 5, the door 22 comprises a carriage 34 and four rollers 36, 37, 38 and 39 carried on the carriage and rollably engaged within the slotways 32 and 33 of the right and left bracket members 30 and 31. As seen in FIG. 5, the carriage 34 is formed as an elongate extrusion which extends from a carriage right side 40 to a carriage left side 41. As seen in FIG. 5, the carriage 34 has a top plate 42 carrying the upper door surface 24. The carriage has a bottom plate 43. The carriage 34 has a front end 44 which steps inwardly as undercut portion 45 to a recessed front face 46 which merges with the bottom plate 43. The carriage 34 has rear end 47 which extends downwardly from the top plate 42. The rear end 47 merges into a first horizontal section 48 merging forwardly into an upwardly extending undercut grip surface 49 which merges into a horizontal section 50 which merges with a recessed rear wall 51 merging with the bottom plate 43. At the front end of the bottom plate 43, the extrusion includes a front journal recess 52. At the rear of the bottom plate 43, the extrusion includes a rear journal recess 53. Each of the journal recesses 52 and 53 have a part cylindrical interior surface within which a front axle 54 and a rear axle 55 are engaged to extend sideways along the length of the extrusion beyond the carriage right side 40 and the carriage left side 41 and upon which the four rollers are journalled for rotation. The four rollers comprise a front right roller 36, the left front roller 37, the right rear roller 38 and the left rear roller 39. When assembled, each of the rollers is journalled on the respective axle 54 or 55 and engaged within the respective right slotway 32 or left slotway 33. The front axle 54 and the rear axle 55, each extend through the slotways 32 and 33 of the bracket members, through the rollers, through each of a respective right end plate 58 and left end plate 59 to a distal end. Four lock nuts 60 are secured to the four distal ends of the axles to retain the end plates 58 and 59 in place and assist in maintaining the rollers within respective slotways.

Figure 6B:
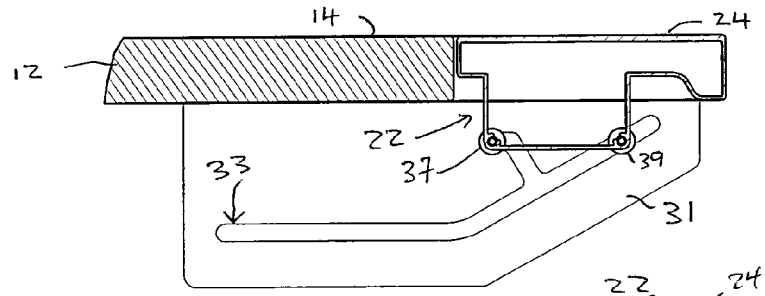
FIGS. 6*b*, 7*b*, 8*b*, 9*b* and 10*b* are each a cross-sectional side view along section line X-X' in FIG. 3 showing the access door and worksurface in corresponding positions to those shown in FIGS. 6*a* to 10*a*, respectively, with FIG. 6*b* showing the closed position of FIG. 6*a*, FIG. 7*b* showing the upper intermediate position of FIG. 7*a*, FIG. 8*b* showing the lower intermediate position of FIG. 8*a*, FIG. 9*b* showing the travel position of FIG. 9*a* and FIG. 10*b* showing the open position of FIG. 10*a;*

As can be seen, for example, in FIG. 6*b*, the front left roller 37 and the rear left roller 39 are rollably engaged within the left slotway 33 of the left bracket member 31 for movement longitudinally within the left slotway 33. The right front roller 36 and the right rear roller 38 are similarly rollably engaged within the right slotway 32 of the right bracket member 30 for movement longitudinally therein.

Figure 4:
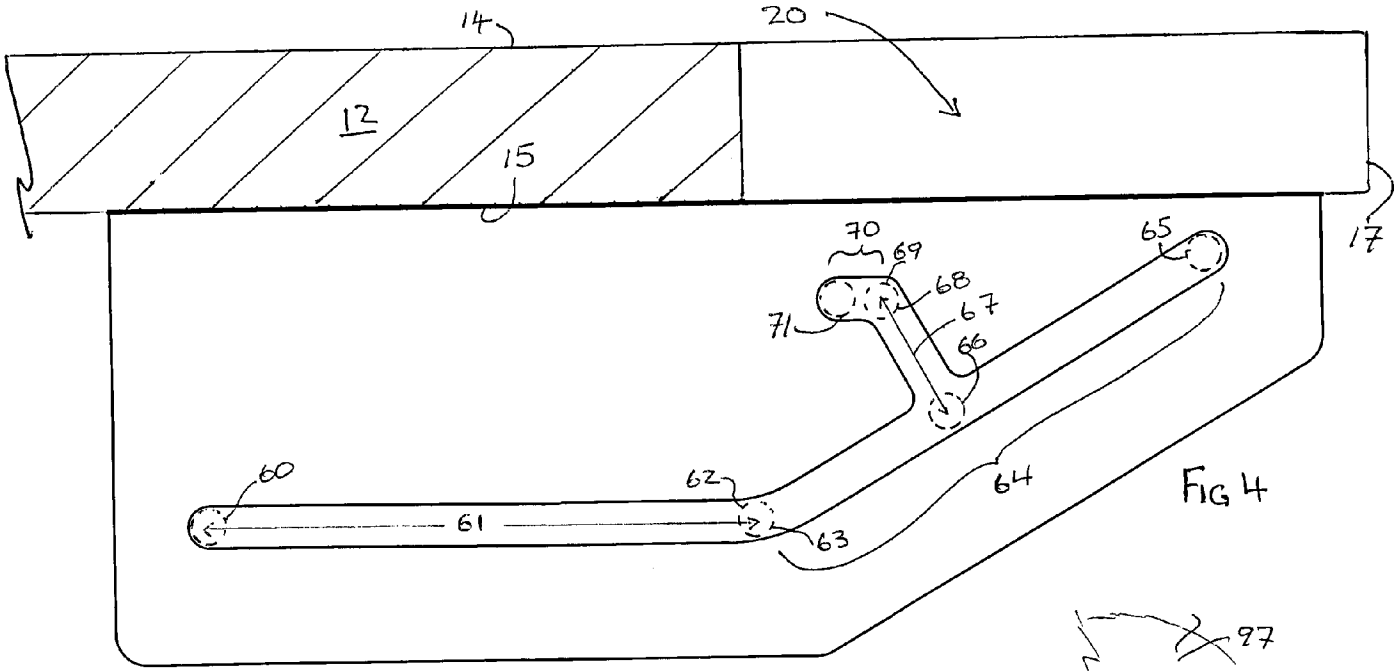
FIG. 4 is a left side view of merely a left bracket member and worksurface as seen from section line X-X' in FIG. 3.

Referring to FIG. 4, the right slotway 32 is now described. The right slotway 32 has a front portion 61, a rear portion 64, a lower branch portion 67 and an upper branch portion 70. Within the right slotway 32, at various locations, circles are shown in broken lines showing locations of ends of each these portions of the right slotway 32. The first portion 61 extends between a closed front end 60 and an open rear end 62. The front portion 61 opens at its rear end 62 into the rear portion 64. The rear portion 64 has a front end 63 coincident with the rear end 62 of the front portion 61. The rear portion extends from its front end 63 to its closed rear end 65. As seen in FIG. 4, the front portion 61 extends from its front end 60 to its rear end 62 parallel to the lower surface 15, that is, horizontally in the preferred embodiment. The rear portion 64 extends from its front end 63 upwardly towards the lower surface 15 as the rear portion 64 extends rearwardly away from its front end 63. In the preferred embodiment, the rear portion 64 is shown as linear and inclined to extend upwardly at a constant angle from its front end 63 to its closed rear end 65.

The lower branch portion 67 extends upwardly from the rear portion 64 spaced from the rear end 65 of the rear portion 64. The lower branch has its lower end 66 in the rear portion 64 intermediate the front end 63 and the rear end 65 of the rear portion 64. The lower branch 67 extends upwardly from its lower end 66 to its upper end 68. In the preferred embodiment, the lower branch 67 is linear and extends upwardly from its lower end 66 to its upper end 68 forwardly as it extends upwardly. The lower branch 67 opens at its upper end 68 into the rear end 69 of the upper branch portion 70. The upper branch portion 70 extends from its rear end 69 forwardly towards the closed forward end 71. In the preferred embodiment, the upper branch extends from its rear end 69 towards its forward end 71 forwardly approximately horizontal and parallel to the lower surface 15.

Reference is now made to FIGS. 6*b*, 7*b*, 8*b*, 9*b* and 10*b* which illustrate successive positions of the door 22 in movement from the closed position of FIG. 6*b* successively to the open position of FIG. 10*b* and, correspondingly, FIGS. 10*b*, 9*b*, 8*b*, 7*b* and 6*b* successively show the successive positions of the door 22 in movement from the open position of FIG. 10*b* to the closed position of FIG. 6*b*. In the preferred embodiments, each of the right slotway 32 and the left slotway 33 is identical and, correspondingly, the door 22 and its carriage 34 are identical on each of its left and right sides in respect of the position and location of the elements of the door, carriage, axles and rollers. The following description of the manner of relative movement of the left side of the door 22 in the left bracket member 31 is equally applicable to corresponding simultaneous positions and movements of the right side of the door 22 within the right bracket member 30.

FIG. 6*b* illustrates a closed position of the door 22 in which the upper door surface 24 is flush with the upper surface 14 of the worksurface 12. In the closed position, the front roller 37 is engaged with the closed front end 71 of the upper branch portion 70 of the slotway 33. The rear roller 39 is in the rear portion 64 of the slotway 33 spaced from the rear end 65 of the rear portion 64. Since the rear portion 64 is angled so as to slope downwardly as it extends forwardly, due to gravity, the camming engagement between the rear portion 64 and the rear roller 39 will urge the door 22 to move forwardly and thus urging the door 24 into the closed position as shown as located in the closed position with the front roller 37 engaging the closed front end 71 of the upper branch 70.

In the preferred embodiment as shown in FIG. 6*b*, the door 22 is urged towards the closed position and stopped in the closed position by engagement between the front roller 37 and the closed front end 71 of the upper branch 70. Other stop mechanisms may be provided as, for example, by the front end 44 of the carriage 34 engaging the opening front end 26 of the opening 20.

Figure 7B:
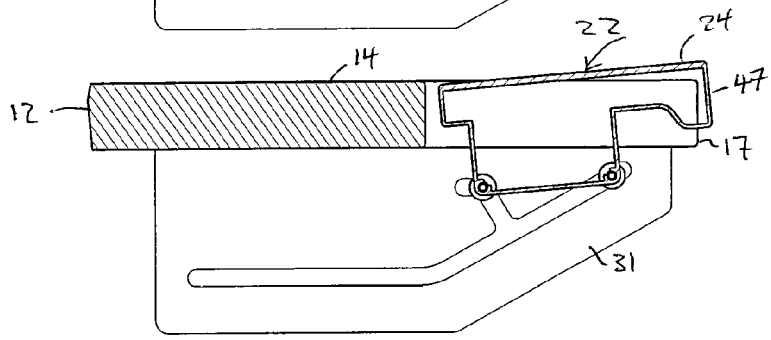
Figure 8B:
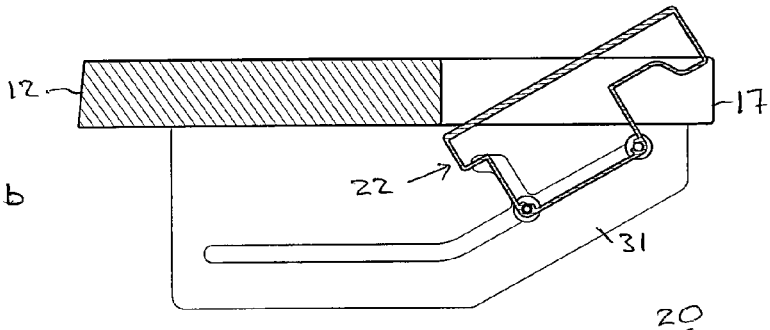

From the closed position of FIG. 6*b*, the door 22 is urged to be moved rearwardly as, for example, by a person engaging the door 22 and manually urging the door towards the rear. With such rearward movement, the rear roller 39 slides rearwardly in the rear portion 64 and the front roller 37 slides forwardly within the upper branch 70 until the front roller 37 reaches the rear end 69 of the upper branch 70 which coincides with the upper end 69 of the lower branch 67. The position of FIG. 7*b* represents an upper intermediate position. In this upper intermediate position, on release of the door 22 by the user, the front roller 37 is at the upper end 68 of the lower branch 67 and, due to gravity, the front roller 37 will move downwardly within the lower branch 67 to the lower end 66 of the lower branch 67 whereupon the door 22 is in the lower intermediate position as seen in FIG. 8*b*. In moving from the upper intermediate position of FIG. 7*b* to the lower intermediate position of FIG. 8*b*, the rear roller 39 has moved to be engaged with the closed rear end 65 of the rear portion 64.

Figure 9B:
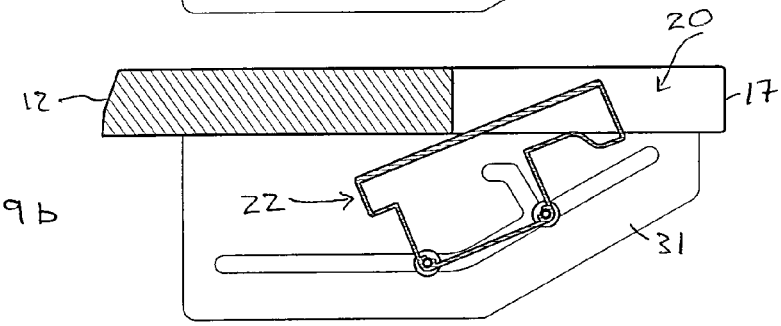

From the position of FIG. 8*b*, with the front roller 37 and the rear roller 39 within the inclined rear portion 64, due to gravity, the front roller 37 and the rear roller 39 are cammed by engagement with the rear portion 64 to slide forwardly through the travel position of FIG. 9*b* to the closed position of FIG. 10*b* with each of the front roller 37 and the rear roller 39 moving through the rear portion 64 forwardly through the front end 63 of rear portion 64, into the front portion 61 towards the front end 60 of the front portion 61. In moving from the lower intermediate position of FIG. 8*b* to the closed position of FIG. 10*b*, the upper surface 24 of the door 22 remains spaced below the lower surface 15 of the worksurface 12. In the preferred embodiment, the upper surface 24 is closest to the intersection of the lower surface 15 of the worksurface 12 and the forward end 26 of the opening 20 in the travel position of FIG. 9*b*.

In the preferred embodiment, once the rear roller 39 reaches the rear end 62 of the front portion 61, neither of the front roller 37 or the rear roller 39 are within portions of the left slotway 33 which are inclined, as can be of assistance in biasing the door 22 to a fully closed position as seen in FIG. 10*b*. However, in the sliding movement under gravity from the lower intermediate position of FIG. 8*b* through the travel position of FIG. 9*b* sufficient momentum is developed by the door 22 so as to continue to move along the horizontal front portion 61 until the front roller 37 engages the closed front end 60 of the front portion 61.

To move the door 22 from the closed position as shown in FIG. 10*b* to the open position as seen in FIG. 6*b*, a user will manually extend their hand from on top of the worksurface 12 down through the opening 20 to engage the rear of the carriage 34 and manually draw the carriage 34 rearwardly to the intermediate lower position as shown in FIG. 8*b*, at which time, the user will then apply a downwardly directed force to the door 22 rearwardly of the rear roller 39 to pivot the door 22 about the rear roller 39 whereupon the front roller 37 will be moved upwardly within the lower branch 67 and from the lower branch 67 into the upper branch 70. Once the front roller 37 is in the upper branch 70, downwardly directed force is directed by the user on the rear end 47 of the door 22 will move the rear roller 39 forwardly in the rear portion 64 which will move the front roller 37 forwardly within the upper branch portion 70. As can be seen in the preferred embodiment, on a user moving the door 22 to the lower intermediate position of FIG. 8*b*, the rear roller 39 engages the rear end 65 of the rear portion 64 which locates the front roller 37 at the lower end 66 of the lower branch 67 such that any downward forces applied to the rear end 47 of the carriage 34 of the door 22 will pivot the door 22 about the rear roller 39 and necessarily move the front roller 37 upwardly within the lower branch 67 and hence into the upper branch 70. To the extent that there is a downward component of the forces manually applied to the rear end 47 of the door 22 once the front roller 37 is within the lower branch 67 or within the upper branch 70, then this downward force will tend to move the front roller 37 upwardly within the lower branch 67 and rearwardly within the upper branch 70.

In the preferred embodiment as illustrated, the rear end 47 of the door 22 is flush with the rear 17 of the worksurface 12 and, as shown, the rear end 47 has the same height as the height of the rear 17 of the worksurface such that the door 22 while closing the opening 20 appears not only flush with the worksurface 12 but also as a continuation of the rear 17 of the worksurface 12.

As can be seen in FIG. 7*b*, on movement of the door 22 from the closed position to the open position, in the upper intermediate position of FIG. 7*b*, the rear end 47 of the door 22 extends rearwardly beyond the rear 17 of the worksurface 12 and the upper door surface 24 extends proximate the rear 17 of the door vertically upwardly above the upper surface 14 of the worksurface 12. To accommodate the use of the door 22 as illustrated in the preferred embodiment, as seen in FIG. 1, the opposed work surfaces 12 are mounted with their rears 17 opposed to each other are provided with a space 99 between the rears 17. The space 99 is sized to be sufficient to permit the rearward movement of the door 24 as seen, for example, in FIG. 7*b*. This space, however, is preferably sized such that there is room for a user to manually engage the rear end 47 with a user's hand 97 as is schematically illustrated in FIG. 5 with the fingers 98 of a user to extend rearwardly of the rear end 47 under the horizontal section 48 and into the undercut grip surface 49. In the preferred embodiment, the access door 22 is mounted adjacent the open rear 17 of the worksurface 12 and could similarly be applied adjacent any open edge of the worksurface as, for example, adjacent either the end 18 or 19 or front 16 provided there is an adequate space for movement of the door to the upper intermediate position.

In FIG. 1, on the upper leftmost worksurface 12, there is shown an access door 22*a* identical to the access door shown in the other three worksurfaces with the exception that the access door 22*a* is provided not open to the rear edge 17 but rather into an opening 20*a* in which the opening rear end 27 is spaced rearwardly from the rear end 47 of the door 22 so as to provide a vertical space 99*a*. This vertical space 99*a* can be of assistance, for example, for the continuous passage of cables as well as being useful to provide a space via which a user's hand may engage the door 22*a*.

In the preferred embodiment, manual manipulation of the door is preferably provided by a user's hand extending over the rear end of the door to engage the door. This is not necessary and other engagement mechanisms may be provided on the door for manual engagement by a user. For example, a slot may be cut into the upper door surface 24 by which the door can be engaged when the door is in a closed position. A handle may be provided which is adapted to pivot from a position recessed within the upper door surface to a position raised relative to the upper door surface and which may, in an open position as in FIG. 10, extend rearwardly to assist a user in manually grasping the door 22 when in the open position.

The access door in accordance with the preferred embodiment of FIG. 1 provides for access through a worksurface 12. The worksurface 12 in FIG. 1 is illustrated as being horizontal. The worksurface 12 may, however, be disposed in a flat plane at an angle to the horizontal as, for example, may be useful with drafting tables and the like. Insofar as the worksurface 12 is disposed at an angle other than horizontal, then the relative location and angulation of the various portions of the slotways may be adjusted to achieve the desired purposes of the slotways interacting with the rollers to: (a) bias the door to a closed position, (b) the door being moved to a first intermediate position in which, under gravity, the door will then pivot about its front roller members to a second intermediate position in which the door will then, under gravity, roll in the slotway to a closed position adjacent the opening. In selecting such an arrangement, in moving from the open position to the closed position, on reaching the second intermediate position, the rear rollers are stopped at a location that the front rollers are disposed to move upwardly within the lower branch portion with pivoting about the rear rollers. When the door is in a position between the upper intermediate position and the closed position or in the closed position, due to gravity, the door is biased towards the closed position and moves to the closed position when displaced therefrom. When the door is in the lower intermediate position or between the lower intermediate position and the upper intermediate position, due to gravity, the door is biased towards the lower intermediate position and moves to the lower intermediate position when displaced. When the door is in the lower intermediate position or positions between the lower intermediate position and the open position in which the rear rollers are in the rear portion, due to gravity, the door is biased towards the open position and moves towards the open position when displaced away from the open position.

In the preferred embodiments, slotways are provided in the brackets and rollers are provided on the door. However, similar arrangements can be achieved with slotways being provided on end brackets on the door and rollers mounted on the bracket members. Similarly, there could be a combination of slotways on the bracket members to be engaged by rollers on the door and rollers on the bracket members to engage slotways on the door.

In the preferred embodiment, each of the left slotway 33 and the right slotway 34 shown as a Y-shaped single slotway with a branch and each of the front wheel and the rear wheel slide through common portions of the slotway. Rather than provide a single slotway, two separate slotways could be provided, one slotway merely for the front roller and a second slotway merely for the rear roller.

In the preferred embodiment, as the door slides under its own moving momentum from the lower intermediate position of FIG. 8*b* to the open position of FIG. 10*b*. On reaching the open position of FIG. 10*b*, the movement of the door 22 is stopped by engagement of the front roller 37 with the closed front end 60 of the front portion 61. This is not necessary and some other stop mechanism may be provided. Preferably, a resilient bumper 95 may be provided mounted between the brackets 30 and 31 as, for example, to engage the front end 44 of the carriage 34 as schematically illustrated in FIG. 10*b*.

This bumper may be secured as, for example, between the bracket members and provide a sound dampening and energy dissipating resilient member.

In accordance with the present invention, the door is preferably moved between the open and closed positions manually by a user. Automated actuators may be provided to engage the door and move it between the open and closed positions.

Referring to FIG. 1, the desk assembly preferably has a vertical partition 94 which extends between the rear legs of the leg structures 11 from one end of each table 10 to the other end of the table which vertical partition 94 has between two spaced removable cover panels raceways therein and with outlets for power and communication mounted in each vertical cover panel. In FIG. 1, such a partition 94 is merely visible under the right front table 10 and a single power outlet 93 is schematically shown. In accordance with the present invention, such outlets are preferably provided in the partition 94 rearward of and below each access door 22 for access by a user on opening of each door. As well, a horizontal open raceway 92 may be provided underneath the table worksurface 12 and supported by the table for lay-in of wiring. Such raceways 92 extend horizontally underneath the worksurface end-to-end of the worksurface proximate the end of the worksurface. Such a platform 94, outlet 93 and raceway 92 are schematically illustrated in FIG. 10*b*.

Figure 11:
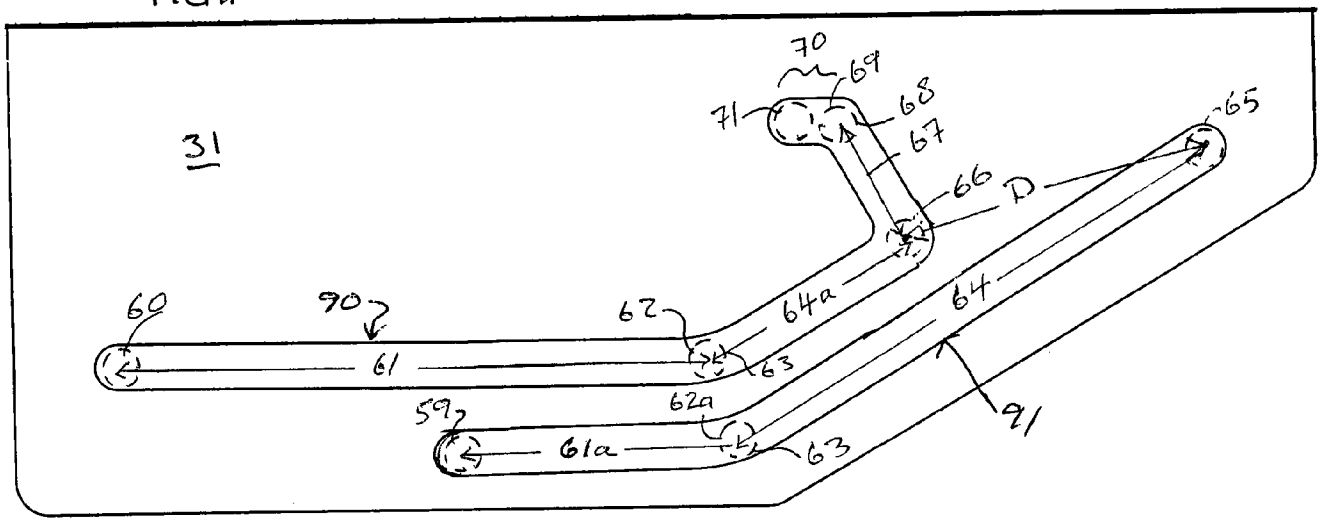
FIG. 11 is a left side view of a left side bracket similar to FIG. 4 but of a second invention.
Figure 12:
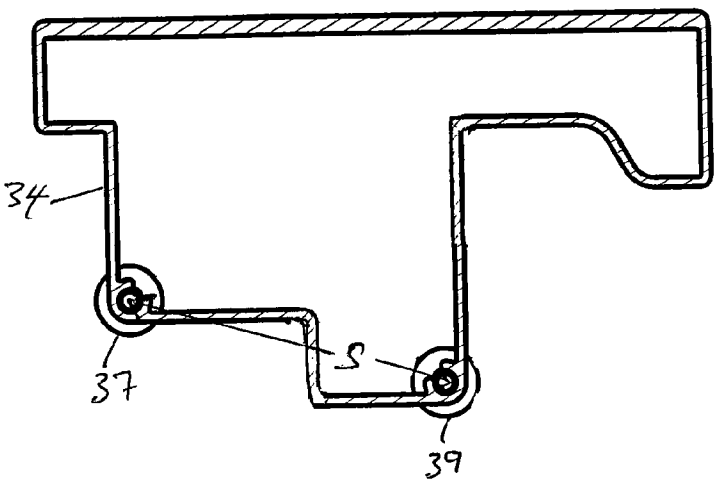
FIG. 12 is a view of a door assembly as in FIG. 5 but of a second embodiment for use with the bracket in FIG. 11.

Reference is made to FIGS. 11 and 12 illustrating a left bracket member 31 and a door 22 in accordance with a second embodiment of the invention. As seen in FIG. 11, two slotways are provided in the left bracket member 31, an upper slotway 90 and a lower slotway 91, however, with each slotway having corresponding portions to those in FIG. 4. The door 22 in FIG. 12 has its upper front roller 37 to be engaged in the upper slotway 90 and a lower rear roller 39 to be engaged in the lower slotway 91. As in the first embodiment, the distance D of end 66 to end 65 in FIG. 11 is equal to the distance S of spacing of the axis about which the rollers 37 and 39 are journalled. The upper slotway 90 includes a shortened rear portion 64*a* in which the front roller 37 runs. The lower slotway 91 includes a shortened front portion 61*a* in which the front rear roller 39 runs ending at front end 59. Operation of the door 22 in the second embodiment is substantially identical to that in the first embodiment.

While the invention has been described with reference to preferred embodiments, many modifications and variations will now occur to persons skilled in the art. For a definition of the invention, reference is made to the following claims.

We claim:

1. A worksurface having an upper surface and a lower surface, and an opening through the work surface, a movable access door having an upper door surface, in a closed position, the door surface is flush with the upper surface oldie worksurface across the opening, in an open position, the door is disposed under the worksurface adjacent to the opening with the upper door surface directed into opposition with the lower surface of the worksurface adjacent to the opening, the opening having an opening front end, an opening rear end, an opening right side and an opening left side, the opening right side and the opening left side joining the opening front end and the opening rear end, a right bracket member secured to the lower surface adjacent the opening right side, a left bracket member parallel to the right bracket member secured to the lower surface adjacent the opening left side, each of the right bracket member and the left bracket member extending downwardly away from the lower surface normal to the lower surface, slotways comprising a Y-shaped right slotway in the right bracket member, and a Y-shaped left slotway in the left bracket member identical to the right slotway, the door having a door front end, a door rear end, a door right side and a door left side, the door right side and the door left side joining the door front end and the door rear end, the door having a carriage which extends downwardly from the door surface, the carriage having a carriage right side and a carriage left side, rollers carried on the carriage comprising a right front roller, a left front roller, a right rear roller and a left rear roller, the right front roller mounted on the carriage right side proximate the door front end for rotation about a front axis, the right rear roller mounted on the carriage right side proximate the door rear end for rotation about a rear axis parallel the front axis spaced rearwardly from the front axis, the left front roller mounted on the carriage left side proximate the door front end for rotation about the front axis, the left rear roller mounted on the carriage left side proximate the door rear end for rotation about the rear axis, the right front roller and right rear roller rollably engaged within the right slotway of the right bracket member for movement longitudinally therein, the left front roller and the left rear roller engaged within the left slotway of the left bracket member for movement longitudinally therein, each slotway having a front portion, a rear portion, a lower branch portion and an upper branch portion, each front portion having a front end and a rear end, each rear portion having a front end and a closed rear end, the rear end of the front portion opening into the front end of the rear portion, the front portion extending from its front end to its rear end parallel to the lower surface, the rear portion extending from its front end upwardly toward the lower surface as it extends away from its front end, each lower branch portion having a lower end and an upper end, each upper branch portion having a closed front end and a rear end, the lower branch portion extending upwardly from rear portion spaced from the rear end of the rear portion with the lower end of the lower branch portion within the rear portion, the upper end of the lower branch portion opening into the rear end of the upper branch portion, the lower branch portion extending from its lower end to its upper end upwardly toward the lower surface, the upper branch portion extending from its rear end toward its forward end forwardly parallel the lower surface, wherein:

(i) in the closed position of the door:

(a) each front roller is in the respective upper branch of each slotway engaged with the Forward end of the upper branch, and (b) each rear roller is in the respective rear portion of each slotway, (ii) in an upper intermediate position of the door:

(a) each front roller is at the junction of the respective upper branch of each slotway and the lower branch of the of each slotway, (b) each rear roller is in the respective rear portion of each slotway, (iii) in a lower intermediate position of the door:

(a) each front roller is at the junction of the respective lower branch and the rear portion of each slotway, and (b) each rear roller is in the respective rear portion of each slotway engaged with the rear end of the rear portion, (iv) in the closed position of the door:

(a) each front roller is in the respective front portion of each slotway, (b) each rear roller is in the front portion of each slotway rearward of each front roller, wherein:

with rolling engagement of the rollers in the slotways when the door is in a position between the rear intermediate position and the closed position or in the closed position, due to gravity the door is biased towards the closed position and moves to the closed position when displaced therefrom, with rolling engagement of the rollers in the slotways when the door is in the rear intermediate position or between the rear intermediate position and the forward intermediate position, due to gravity the door is biased towards the forward intermediate position and moves to the forward intermediate position when displaced, with rolling engagement of the rollers in the slotways when the door is in the forward intermediate position or positions between the forward intermediate position and the open position in which the rear rollers are in the rear portion, due to gravity the door is biased towards the open position and moves toward the open position when displaced away from the open position.

2. A worksurface having an upper surface and a lower surface, and an opening through the work surface, a movable access door having an upper door surface, in a closed position, the door surface is flush with the upper surface of the worksurface across the opening, in an open position, the door is disposed under the worksurface adjacent to the opening with the upper door surface directed into opposition with the lower surface of the worksurface adjacent to the opening, the opening having an opening front end, an opening rear end, an opening right side and an opening left side, the opening right side and the opening left side joining the opening front end and the opening rear end, a right bracket member secured to the lower surface adjacent the opening right side, a left bracket member parallel to the right bracket member secured to the lower surface adjacent the opening left side, each of the right bracket member and left bracket member extending downwardly away from the lower surface normal to the lower surface, the right bracket having a right first slotway and a right second slotway, the left bracket having a left first slotway and a left second slotway identical respectively to the right first slotway and the left second slotway of the first bracket, the door having a door front end, a door rear end, a door right side and a door left side, the door right side and the door left side joining the door front end and the door rear end, the door having a carriage which extends downwardly from the door, the carriage having a carriage right side and a carriage left side, the carriage having a right front roller, a left front roller, a right rear roller and a left rear roller, the right front roller mounted on the carriage right side proximate the door front end for rotation about a front axis, the right rear roller mounted on the carriage right side proximate the door rear end for rotation about a rear axis parallel the front axis spaced rearwardly from the front axis a distance, the left front roller mounted on the carriage left side proximate the door front end for rotation about the front axis, the left rear roller mounted on the carriage left side proximate the door rear end for rotation about the rear axis, the right front roller engaged within the first slotway of the right bracket member, the right rear roller engaged within the second slotway of the right bracket member, the left front roller engaged within the first slotway of the left bracket member, the left rear roller engaged within the second slotway of the left bracket member, each first slotway having a front first slotway portion and a rear first slotway portion, each front first slotway portion having a closed front end and a rear end, each rear first slotway portion having a front end and a rear end, the rear end of the front first slotway portion opening into the front end of the rear first slotway portion, the front first slotway portion extending parallel to the lower surface, the rear first slotway portion extending from its front end upwardly toward the lower surface as it extends away from its front end, each second slotway having a front second slotway portion, a lower branch portion and an upper branch portion, each front second slotway portion having a closed front end and a rear end, each lower branch portion having a lower end and an upper end, each upper branch portion having a closed front end and a rear end, the rear end of the front second slotway portion opening into the lower end of the lower branch portion, the upper end of the lower branch portion opening into the rear end of the upper branch portion, each front second slotway portion extending parallel to the outer surface outer surface, the lower branch portion extending from its lower end to its upper end upwardly toward the lower surface, the upper branch portion extending from its rear end toward its forward end forwardly and downwardly away from the lower surface, in the closed position of the door:

(a) each front roller is in the respective upper branch of the first slotway engaged with the forward end of the upper branch, (b) each rear roller is in the respective rear first slotway portion of the second slotway, in a rear intermediate position of the door:

(a) each front roller is at the junction of the respective upper branch of the first slotway and the lower branch of the of the first slotway, and (b) each rear roller is in the respective rear first slotway portion of the second slotway, in a front intermediate position of the door:

(a) each front roller is at the junction of the respective lower branch of the first slotway and the front first slotway portion of the first slotway, and (b) each rear roller is in the respective rear first slotway portion of the second slotway engaged with the rear end of the rear first slotway portion of the second slotway, in the closed position of the door:

(a) each front roller is in the respective front first slotway portion of the first slotway, (b) each rear roller is in the respective front second slotway portion of the second slotway, and (c) either each front roller is in engagement with the front end of the front first slotway portion of the first slotway or the each rear roller is in engagement with the front end of the front second slotway portion of the second slotway, when the door is in a position between the rear intermediate position and the closed position or in the closed position, due to gravity the door is biased towards the closed position and moves to the closed position with rolling engagement of the first and second rollers in the respective slotways, when the door is in the rear intermediate position or between the rear intermediate position and the forward intermediate position, due to gravity the door is biased towards the forward intermediate position and moves to the forward intermediate position with rolling engagement of the first and second rollers in the respective slotways, when the door is in the forward intermediate position or between the forward intermediate position and the open position, due to gravity the door is biased towards the open and moves to the open position with rolling engagement of the first and second rollers in the respective slotways.

3. A worksurface as claimed in claim 2 wherein in the closed position of the door:

each front roller is in engagement with the front end of the front first slotway portion of the first slotway.

4. A worksurface as claimed in claim 3 wherein the front first slotway portion of the first slotway comprises the front second slotway portion of the second slotway.

* * * * *